United States Patent [19]

Theurer

[11] Patent Number: 4,794,862

[45] **Date of Patent: * Jan. 3, 1989**

[54] TRACK LEVELING AND BALLAST TAMPING MACHINE

[75] Inventor: Josef Theurer, Vienna, Austria

[73] Assignee: Franz Plasser Bahnbaumaschinen-Industriegesellschaft m.b.H., Vienna, Austria

[ * ] Notice: The portion of the term of this patent subsequent to Sep. 13, 2005 has been disclaimed.

[21] Appl. No.: 944,365

[22] Filed: Dec. 22, 1986

[30] Foreign Application Priority Data

Feb. 12, 1986 [AT] Austria ..... 358/86

[51] Int. Cl.[4] ..... E01B 27/17; E01B 27/11

[52] U.S. Cl. ..... 104/7.2; 104/12; 171/16; 37/104

[58] Field of Search ..... 104/2, 7.1, 9, 10, 12, 104/17.1, 7.2; 105/248; 37/104–107; 171/16

[56] References Cited

U.S. PATENT DOCUMENTS

| | | | |
|---|---|---|---|
| 3,315,616 | 4/1967 | Beaver et al. | 105/248 |
| 3,680,486 | 8/1972 | Plasser et al. | 104/1 |
| 3,877,160 | 4/1975 | Plasser et al. | 37/104 |
| 4,160,418 | 7/1979 | Theurer | 104/2 |
| 4,257,331 | 3/1981 | Theurer et al. | 104/2 |
| 4,263,851 | 4/1981 | Theurer et al. | 104/2 X |
| 4,393,784 | 7/1983 | Theurer | 104/17.1 X |
| 4,430,944 | 2/1984 | Theurer | 104/2 X |
| 4,479,439 | 10/1984 | Theurer et al. | 104/7.1 |
| 4,534,295 | 8/1985 | Theurer | 104/12 X |
| 4,538,687 | 9/1985 | Theurer et al. | 171/16 |
| 4,628,822 | 12/1986 | Theurer | 104/12 X |

FOREIGN PATENT DOCUMENTS

| | | | |
|---|---|---|---|
| 197302 | 10/1957 | Austria . | |
| 353820 | 12/1979 | Austria . | |
| 1191739 | 8/1985 | Canada . | |
| 0057128 | 5/1984 | European Pat. Off. . | |
| 2612536 | 10/1976 | Fed. Rep. of Germany | 171/16 |
| 2135369 | 2/1986 | United Kingdom . | |

OTHER PUBLICATIONS

Railway Gazette International, Feb. 1985, pp. 120/1.

*Primary Examiner*—Robert B. Reeves
*Assistant Examiner*—Scott H. Werny
*Attorney, Agent, or Firm*—Kurt Kelman

[57] ABSTRACT

A track leveling and ballast tamping machine comprises a standard vehicle capable of being coupled to a train, two undercarriages supporting the frame for movement in an operating direction along a track and a drive for moving the frame along the track. A ballast tamping unit is connected to the frame between the undercarriages and a track lifting unit is connected to the frame between the undercarriages ahead of the ballast tamping unit in the operating direction, a track leveling reference system controlling the lifting of the track by the track lifting unit. A ballast receiving and storage container is mounted on the frame ahead of the ballast tamping and track lifting units in a forward portion thereof, the container having adjustable outlet ports for distributing ballast in respective ones of the cribs, and a ballast conveyor is arranged on the frame for conveying ballast to the ballast receiving and storage container in the forward portion of the frame, in the operating direction.

22 Claims, 2 Drawing Sheets

TRACK LEVELING AND BALLAST TAMPING MACHINE

BACKGROUND OF THE INVENTION (1) Field of the Invention

The invention relates to a track leveling and ballast tamping machine comprising a standard vehicle capable of being coupled to a train and having a machine frame, two undercarriages supporting the frame for movement in an operating direction along a track comprised of two rails fastened to ties defining cribs therebetween, the undercarriages being sufficiently spaced apart in this direction to permit lifting of the track therebetween, and a drive for moving the frame along the track. A ballast tamping unit is connected to the frame between the undercarriages and comprises pairs of vibratory and reciprocatory tamping tools for tamping ballast under respective ones of the ties, a track lifting unit is connected to the frame between the undercarriages and ahead of the ballast tamping unit in the operating direction at a fixed distance therefrom, and a track leveling reference system controls the lifting of the track by the track lifting unit.

(2) Description of the Prior Art

Canadian Pat. No. 1,191,739, issued Aug. 13, 1985, discloses a track leveling, lining and tamping machine which intermittently advances from tamping stage to tamping stage. Such a machine may be used in conjunction with other track working machines, such as a ballast cleaning machine operating ahead of the track leveling, lining and tamping machine, in the operating direction, and a track bed stabilizing machine following the track leveling, lining and tamping machine to form a mechanical track rehabilitation train. The track working machines of this train are independently driven. The encrusted ballast removed from the track bed by the excavating chain of the ballast cleaning machine is cleaned thereon and the cleaned ballast is redistributed to enable the succeeding track leveling, lining and tamping machine to tamp the cleaned ballast under the leveled and lined track at the intersections of the ties and track rails. After stabilization, the lined track is firmly positioned at a correct level. However, the tamped ballast supports for the track at the intersections of the ties and rails are not always uniform because the cleaned ballast is not quite uniformly distributed by the ballast cleaning machine preceding the track tamper.

British Pat. No. 2,135,369, published Feb. 12, 1986, discloses a continuously moving track leveling, lining and tamping machine of this general type, which has a main frame advancing continuously along the track while a tool carrier between the undercarriages has one end pivotally connected to the main frame and an opposite end supported by a guide carriage for intermittently advancing the carrier from tamping stage to tamping stage. A tamping tool unit is mounted on the tool carrier immediately preceding the guide carriage, in the operating direction, and a track lifting and lining unit is arranged on the tool carrier preceding the tamping tool unit. An hydraulically operated cylinder-piston drive adjusts the position of the tool carrier relative to the main frame at the point where the one tool carrier end is pivotally supported on the main frame. Such a non-stop operable track tamper has not only proven to be very productive in track rehabilitation work but provides a much more comfortable working environment for the machine operators than conventional tampers, is highly energy-effective and greatly saves wear on the machine drive and brakes because the operators sitting on the heavy main frame are not subjected to intermittent acceleration and deceleration impacts.

U.S. Pat. No. 4,538,687, dated Sept. 3, 1985, discloses a non-stop operating ballast cleaning machine preceded, in the operating direction, by a track lifting and ballast tamping unit. This unit is longitudinally displaceable for intermittent advancement thereof and is pivotally coupled to the frame of the ballast cleaning machine. The track lifting and tamping unit enables the track to be lifted by tamping ballast under the ties so that the excavating chain of the succeeding ballast cleaning machine, which extends transversely in the ballast bed underneath the track, does not unduly bend the track rails.

Austrian Pat. No. 197,302, of Oct. 15, 1957, discloses a standard vehicle capable of being coupled to a train and having a frame supported on two undercarriages and carrying a ballast excavating chain, means for redistributing the cleaned ballast and a surface tamper for sufficiently compacting the redistributed ballast in the cribs to enable the rear undercarriage to travel on the track.

U.S. Pat. No. 4,479,439, dated Oct. 30, 1984, discloses a non-stop operating track rehabilitation apparatus comprising a work car with a ballast excavating chain, conveyor arrangements for the separate conveyance of sand and ballast, and a track lifting and tamping unit following the excavating chain, in the operating direction, may be longitudinally displaceably mounted on the work car. A freight train with a track for gantry cranes follows the work car. The sand and ballast required for the track rehabilitation are stored in containers on the freight train and are brought by gantry crane to a sand storage receptacle on the work car and a ballast storage receptacle on the train, respectively. In one embodiment, a track lifting and tamping unit is longitudinally adjustably mounted on a first freight car immediately following the work car and rearwardly of the ballast storage container mounted thereon. An input end of a ballast conveyor is positioned below the ballast storage container and a discharge end of the conveyor is positioned to throw the ballast on the excavated track bed behind the excavating chain. This track rehabilitation apparatus requires an exceptionally efficient conveyor arrangement for the sand and ballast because the sand layer and the ballast layer for the entire track bed are deposited in a single operating stage.

In connection with a track renewal train equipped for continuous replacement of track rails and ties, as disclosed, for example, in U.S. Pat. No. 4,160,418, dated July 10, 1979, a mobile flatbed car according to U.S. Pat. No. 3,680,486, dated Aug. 1, 1972, may be used, which has a series of operator's cabs mounted underneath the flatbed and conveyors for rail fastening elements conveying the fastening elements from and to the cabs to enable operators therein quickly to remove and attach the fastening elements for respectively detaching and attaching the rails from and to the ties. However, it may be difficult to fasten the laid rails to the ties with this apparatus because the deposition of ballast in the cribs may make it impossible for the fastening tools to engage the fastening elements.

U.S. Pat. No. 3,877,160, dated Apr. 15, 1975, and Austrian Pat. No. 353,820, dated Dec. 10, 1979, disclose ballast plow arrangements designed to distribute ballast uniformly over a track bed and to impart a desired profile to the ballast bed. A broom follows the ballast plow arrangement, in the operating direction, and sweeps excess ballast to an elevating conveyor preceding the broom and conveying the excess ballast into a ballast storage container.

Railway Gazette International, February 1985, pages 120/1, describes a track bed rehabilitation train in which a track rehabilitation machine is placed between a waste materials train ahead and a new material skip train behind. The old ballast is excavated and removed while a sand and superposed new ballast layer is deposited during the continuous advance of the train. The train comprises the centrally positioned track rehabilitation machine comprising a ballast excavating chain and conveyor arrangements for conveying the sand and new ballast to the machine, a satellite car and a number of freight cars following the machine. The satellite car runs on undercarriages at each end of the car and carries therebetween a track lifting and lining unit as well as a ballast tamping unit, the units being cyclically displaceable from tamping stage to tamping stage while the entire train advances continuously. While the old ballast excavated by the excavating chain is conveyed to silo cars ahead of the machine, containers filled with sand and new ballast are brought by gantry cranes to sand and ballast storage containers, respectively, whence the sand and new ballast is conveyed forwardly to a discharge point at the machine just behind the excavating chain. In addition to this primary ballast discharge point, another discharge of ballast is provided ahead of the tamping unit. The satellite car is integrated in the train by the track for the gantry crane and the conveyor arrangement for bringing the new ballast to the machine. While this installation has been used with great success, it requires highly efficient conveyor arrangements for the sand and the ballast.

U.S. Pat. No. 4,257,331, dated Mar. 24, 1981, discloses a mobile track surfacing machine comprising a ballast cleaning machine and a trailing track compacting machine coupled thereto. A thrust ballast tamping unit is longitudinally displaceably mounted on the frame of the trailing machine between the undercarriages thereof and a track lifting and lining unit precedes the thrust ballast tamping unit and is fixedly mounted on the frame. The tamping unit has thrust tamping tools immersible in the cribs for compacting the ballast therein, and this requires a relatively large amount of ballast, which is made available by extending a ballast conveyor beyond the rear end of the preceding ballast cleaning machine over a ballast storage bin at the front end of the trailing machine frame. The bin has a ballast output chute with a shutter controllable by a drive whereby clean ballast may be delivered in metered amounts into the cribs so that a sufficient amount of ballast is available for effective tamping by the thrust tamping tools, the major amount of the cleaned ballast being redistributed through the chute on the ballast cleaning machine. The ballast compaction provided by the thrust tamping tools in the cribs is useful only to provide sufficient track stability immediately after the ballast cleaning operation to permit high-speed train traffic to pass but this machine cannot be used for permanent and accurate track correction and tamping obtained with pairs of vibratory and reciprocatory tools tamping the ballast under the ties after the track has been properly positioned by a track lifting and lining unit keeping a constant distance from the tamping unit, the track lifting unit of the trailing auxiliary machine being fixed on the machine frame too close to the front axle to permit substantial track lifting while the crib ballast compacting unit moves back and forth.

Finally, European Pat. No. 0 057 128, published Aug. 4, 1982, shows a machine for the spot replacement of individual damaged railroad ties, which comprises a standard vehicle capable of being coupled to a train and having a frame, two undercarriages supporting the frame and spaced apart in an operating direction, and a drive for moving the frame along the track. A ballast tamping unit is mounted on the frame between the undercarriages and comprises pairs of reciprocatory tamping tools for tamping ballast under the ties. A ballast receiving and storage container is centrally mounted on the frame immediately ahead of the tamping unit and has adjustable outlet port means for distributing ballast in the cribs. A ballast conveyor is arranged on the frame for conveying ballast to the ballast receiving and storage container in the center of the frame from a rear end thereof, in the operating direction. A tie conveying and gripping apparatus is mounted on the frame between the undercarriages immediately ahead of the container. This type of machine is used for the replacement of individual damaged ties by new ties. Since the new tie lies loosely on the track bed, ballast is distributed through the outlet port means at the newly laid tie, and this ballast is then spot tamped under the tie. The machine has a device for holding the track at its level while the spot tamping proceeds. Only individual ties, or at most two ties at a time, may be replaced with this machine in any operating cycle. Such a machine can be used in practical operations only as an auxiliary machine for the replacement of one or two ties at a time and if it were used along a track section which has many damaged ties that need replacement, this track section would become worse and worse as the machine advances thereover. A cyclic tamping of successive ties in a continuous operation along an extended track section is neither possible nor contemplated with this machine which has no track correction reference system, and since the correction of one tie would destroy the position of the other, ties.

SUMMARY OF THE INVENTION

Considering this state of the art, it is the primary object of this invention to provide a track leveling and ballast tamping machine of the first-described type, which is better adapted to cope with various track and ballast conditions so that a more uniform and improved tamping of the ballast under the ties may be obtained over extended lengths of track.

The above and other objects are accomplished in such a machine by mounting a ballast receiving and storage container on the frame of the standard vehicle ahead of the ballast tamping and track lifting units, the container having adjustable outlet port means for distributing ballast in respective cribs, and a ballast conveyor means is arranged on the frame for conveying ballast to the ballast receiving and storage container from a front end of the frame, in the operating direction.

The term "standard vehicle" is used throughout the specification and claims to designate a vehicle of a dimension and structure enabling it to be coupled to, or incorporated into, a railroad train like a regular railroad car.

The track leveling and ballast tamping machine may accordingly be incorporated in a track renewal train, or it may be coupled to, or used in conjunction with, a mobile ballast cleaning machine or a ballast transporting freight train, or it may be used by itself.

Such a machine makes it possible to obtain a more uniform and correspondingly better tamping of the ballast under a succession of ties along long stretches of track, independently of the ballast condition at the individual ties and without the need of additional machinery because a source of a desired amount of ballast is available at all times immediately at the point of tamping. Independent of any other machine, the track leveling and ballast tamping machine of the invention, with its container filled with ballast, can produce very uniform, high-quality tie tamping while fixing the track at a desired level and/or line if the track lifting unit is equipped also for aligning the track. The ballast conveyor means on the frame enables the ballast receiving and storage container to be filled with ballast coming from other track work machines or freight cars, or from a pile of ballast stored at a railroad station. Since the ballast receiving and storage container is mounted on the frame ahead of the ballast tamping and track lifting units, in the operating direction, the operator monitoring the tamping may also control the adjustable outlet port means of the container to distribute ballast in respective cribs in a desired manner and to the desired extent, including cribs adjacent to double ties, for example, which require larger amounts of ballast to produce effective tamping of ballast under the double tie. In this manner, the track leveling and ballast tamping machine of this invention can be economically used not only for obtaining desirable amounts of ballast in the cribs for an effective tie tamping operation but, in a single operating cycle, to level the track and tamp the ties with sufficient amounts of ballast to produce a uniform and firm support for the leveled track.

This machine has universal use in conjunction with all sorts of track working vehicles which provide ballast, for example a track renewal train which generates ballast during the renewal operation or carries along new ballast, a ballast cleaning machine which produces cleaned ballast, or a simple ballast transporting freight train. This is, therefore, a universally useful track leveling and ballast tamping machine adaptable for intermittent advance or continuous advance with a continuously advancing train to which it is coupled if the track lifting and ballast tamping units are connected to the machine frame with longitudinal adjustment with respect to the frame. The ballast conveyor means arranged on the frame for conveying ballast to the ballast receiving and storage container enables the machine at all times to carry sufficient ballast for working along very long stretches of track without interruption.

BRIEF DESCRIPTION OF THE DRAWING

The above and other objects, advantages and features of this invention will become more apparent from the following detailed description of certain now preferred embodiments thereof, taken in conjunction with the accompanying, generally schematic drawing wherein.

DETAILED DESCRIPTION OF PREFERRED EMBODIMENTS

Figures 1, 2, 3:
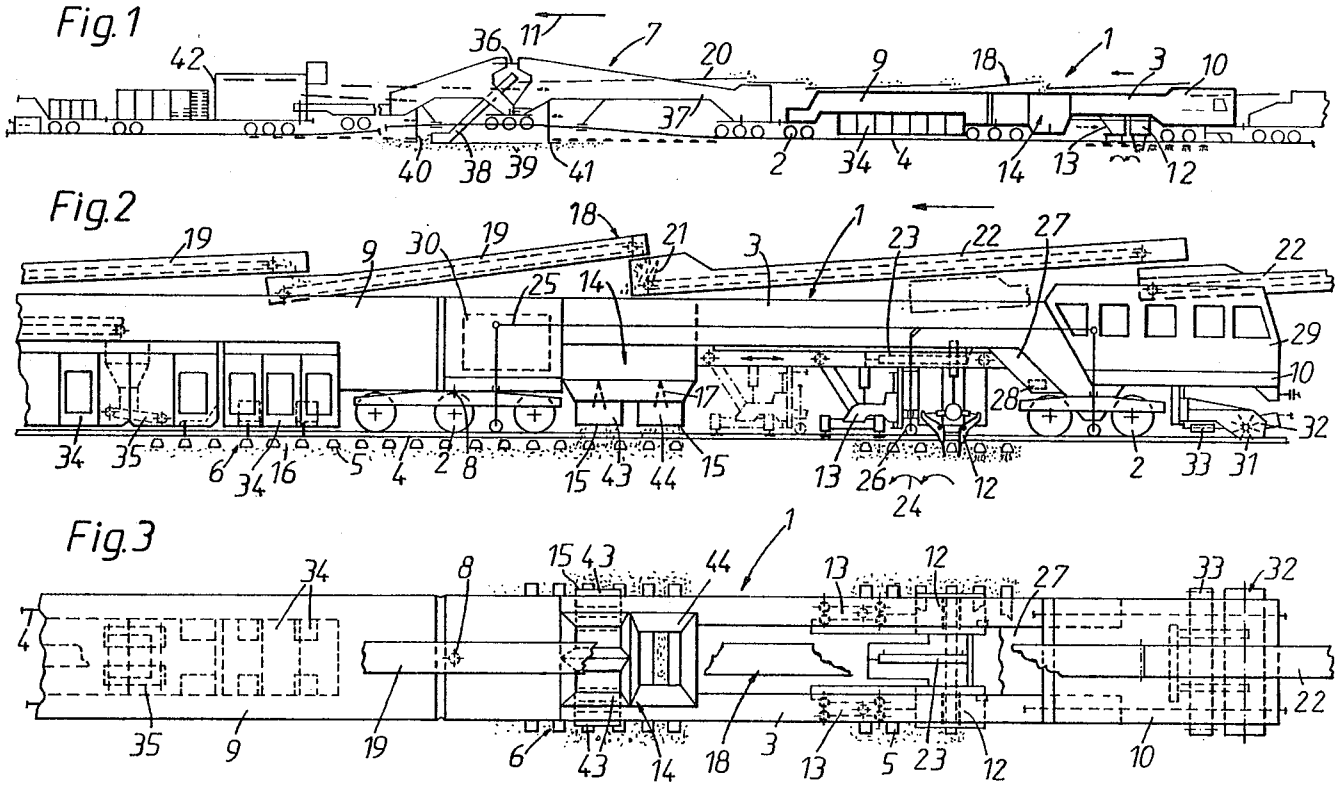
FIG. 1 is a diagrammatic side elevational view of a track renewal train incorporating a track leveling and ballast tamping machine of the invention.
FIG. 2 is a like, enlarged view of the track leveling and ballast tamping machine of FIG. 1.
FIG. 3 is a top view of the machine of FIG. 2.

Referring now to the drawing and first to FIGS. 1 to 3, illustrated track leveling and ballast tamping machine 1 comprises a standard vehicle capable of being coupled to track renewal train 7 and having machine frame 3, two undercarriages 2, 2 supporting frame 3 for movement in an operating direction indicated by arrow 11 along track 6 comprised of two rails 4 fastened to ties 5 defining cribs 16 therebetween, and drive 30 for moving machine frame 3 along track 6. Track renewal train 7 moves continuously along the track as it replaces rails 4 and ties 5, and the machine frame comprises front part 9 and rear part 10 pivotally connected to each other at 8, pivot 8 enabling machine parts 9 and 10 to pivot about a vertical axis for lateral movement in relation to each other. Ballast tamping unit 12 and track lifting and lining unit 13 ahead of it in the operating direction are connected to, and mounted on, rear machine frame part 10 for common relative longitudinal movement with respect thereto. Ballast tamping unit 12 comprises pairs of vibratory and reciprocatory tamping tools for tamping ballast under respective ties 5. Track leveling reference system 25 controls the lifting of track 6 by track lifting unit 13. Reference system 25 comprises track rail sensing roller 26 carrying a rod with a fork-shaped end wherein a tensioned reference wire is held. Ballast receiving and storage container 14 is mounted on machine frame 3 ahead of the ballast tamping and track lifting units in a front portion of machine frame 3 and has adjustable outlet port means 15 for distributing ballast in respective cribs 16. The outlet port means comprises outlet ports and hydraulically operable gates 17 pivotal about transverse axes for adjusting the opening of the outlet ports for controlling the flow of ballast through the ports. Ballast conveyor means 18 is arranged on machine frame 3 for conveying ballast to ballast receiving and storage container 14 in a forward portion of the frame, in the operating direction. The illustrated ballast conveyor means comprises a series of successive conveyor bands 19 extending above front and rear frame parts 9, 10, the successive conveyor bands 19 being in alignment with, and constituting an extension of, ballast conveyor arrangement 20 on track renewal train 7. Ballast deflecting device 21 is arranged above ballast receiving and storage container 14 for selectively deflecting ballast conveyed by successive conveyor bands 19 into the container or to a successive conveyor band 22.

The ballast tamping unit 12 with track lifting and lining unit 13 is mounted on machine frame 3 in longitudinally extending guides for relative longitudinal movement with respect to the frame and drive 23 effectuates a cyclic longitudinal movement, as indicated by arrow 24, from crib to crib whereby standard vehicle 1 may move continuously along track 6 in the operating direction indicated by arrow 11 while units 12, 13 are driven intermittently.

Operator's cab 27 has central control panel 28 and is arranged on machine frame 3 within view of track lifting and ballast tamping units 12, 13 and machine driver's cab 29 is mounted on the frame immediately behind cab 27 at the rear end of the machine frame. Drive 30 enables the machine to be self-propelled and thus to relieve the track renewal train.

Broom arrangement 32 is mounted on the standard vehicle behind ballast tamping unit 12, in the operating direction, and comprises vertically adjustable rotary broom 31 rotatable about an axis extending transversely to the operating direction. In the illustrated embodiment, the broom arrangement is mounted on frame 3 behind rear undercarriage 2, in the operating direction, underneath driver's cab 29. A transversely extending conveyor band 33 is arranged to remove ballast or debris swept up by broom 31 to the shoulders of the track. This broom arrangement sweeps the ballast distributed through adjustable outlet port means 15 from the top of the ties into the cribs, which compensates for the lowering of the ballast bed due to tamping ballast under the ties, and excess ballast is discharged by the transverse conveyor on the track shoulder.

A series of operator's cabs 34 are mounted on an underside of front frame part 9 enabling operators therein to fasten track rails 4 to successive ties 5, and vibratory conveyor band means 35 are mounted on the underside of the front frame part for coveying track rail fastening elements to cabs 34.

A standard vehicle with a two-part machine frame of the described structure is particularly well adapted for use with a track renewal train since it permits the unhindered fastening of the rails to the ties before the cribs are filled with ballast. The centrally pivoted construction of the two-part frame enables the machine to be readily coupled to a track renewal train with the conveyors and without requiring any retrofitting. With the successive conveyor bands on the machine frame constituting an extension of the ballast conveyor arrangement on the track renewal train, the cleaned ballast is conveyed without hindrance and without interfering with the working tools therebelow from the ballast excavating chain on the track renewal train to the ballast receiving and storage container on the machine frame of the track leveling and ballast tamping machine. The deflecting device above the container enables any excess ballast to be conveyed by a successive conveyor band to the rear end of the machine and thence to a trailing silo car without interruption of the continuous ballast flow.

Generally conventional track renewal train 7 comprises two-part main car frame 37, the two car frame parts being interconnected by drive 36 which can spread the two parts, means 40 and 41 on the main car frame for receiving old ties and laying new ties, means for turning the ties 90° for transporting the ties from and to tie receiving and laying means 40, 41, vertically adjustable ballast excavating chain 38 for excavating and planing ballast 39, and ballast conveyor arrangement 20 for receiving the excavated ballast from the ballast excavating chain. The renewal train also comprises gantry crane 42 running on a continuous track on the train for taking away the old ties and bring the new ties to the renewal site.

As shown in FIG. 3, the adjustable outlet port means 15 of ballast receiving and storage container 14 comprises four outlet chutes 43 extending over the respective crib in the operating direction, the outlet chutes being adjacent each other in a direction transverse to the operating direction. A further outlet chute 44 is arranged behind the four outlet chutes 43 in the operating direction for distributing ballast in a center region of the track between the rails. Such an outlet port means arrangement with four ballast outlet chutes corresponding to four rows of tamping tools provided in standard tamping units provides a ballast distribution specifically aimed at the four intersections between adjacent ties and the two rails. Two transverse rows of four outlet ports may be spaced from each other a distance corresponding to the spacing of the ties. By independently operating the pivotal gates of each outlet chute, it is possible to take into account any irregular distribution of ballast transversely to the operation direction.

Figures 4, 5, 6, 7:
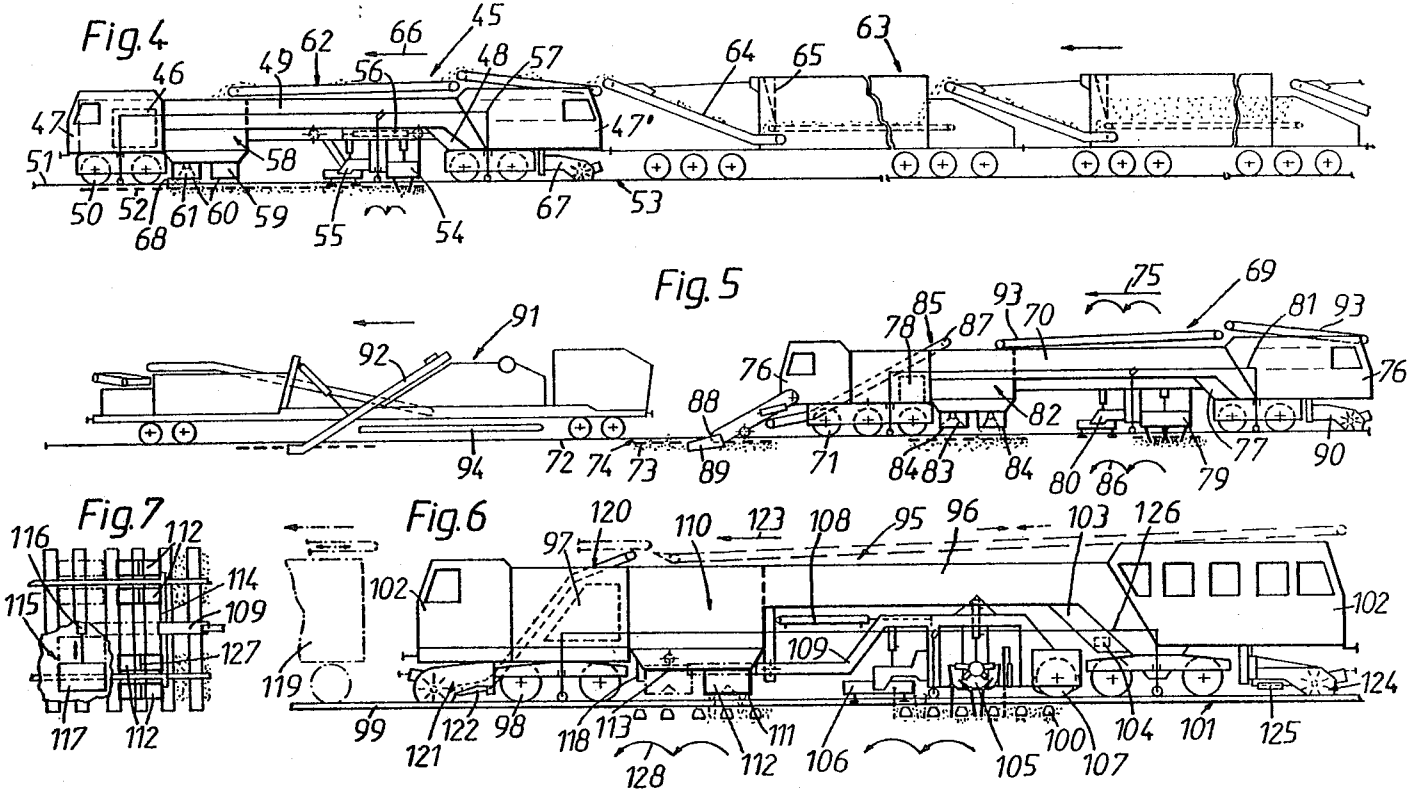
FIG. 4 is a view similar to that of FIG. 1, showing another embodiment of the machine coupled to the front end of a ballast transporting freight train.
FIG. 5 is a like view of a further embodiment of the machine equipped with a twin ballast tamping unit and trailing a mobile ballast cleaning machine driven independently of the track leveling and ballast tamping machine.
FIG. 6 is a side elevational view of yet another embodiment of the machine equipped with a tool carrier having a frame with a forwardly projecting pole having one end linked to the machine frame for longitudinal adjustment with respect thereto and a guide carriage supporting the opposite tool carrier frame end on the track, the track lifting and ballast tamping units being mounted on the tool carrier, whereby the machine frame may advance continuously while the tool carrier is intermittently moved with respect to the machine frame.
FIG. 7 is a fragmentary top view diagrammatically showing the outlet port chutes of the ballast receiving and storage container of the machine of FIG. 6.

Track leveling and ballast tamping machine 45 shown in FIG. 4 is a self-propelled standard vehicle driven by drive 46 and adapted for universal use. It comprises a first operator's cab 48 arranged on frame 49 of the machine within view of track lifting and ballast tamping units 55, 54, and second operator's cab 47 arranged on the frame at the front frame end within view of ballast receiving and storage container 58 for monitoring and controlling adjustable outlet port means 59. Front cab 47 also houses the driver of the machine. Providing a special cab for monitoring and controlling the ballast flow from container 58 makes it possible rapidly to change this flow in accordance with observed ballast conditions. To make it possible to move the machine in either direction when moved between operating sites, another driver's cab 47' is mounted at the rear frame end.

Machine frame 49 is supported on two swivel trucks 50 for movement in an operating direction indicated by arrow 66 along track 53 comprised of two rails 51 fastened to ties 52 defining cribs therebetween. Longitudinally extending drive 56 connects ballast tamping and track lifting/lining units 54, 55 for cyclic or intermittent relative movement to the machine frame while the frame is continuously driven by drive 46. Track leveling reference system 57 is mounted on the machine frame for movement therewith for controlling the lifting of the track by the track lifting/lining unit. Ballast receiving and storage container 58 with outlet port chutes 59 is mounted on frame 49 between front swivel truck 50 and track lifting/lining unit 55 in a forward portion of machine frame 49 and outlet ports 60 of the chutes are adjustable by hydraulically operable gates. A tie sensor mechanism 68 is associated with the front row of the outlet chutes to control the hydraulic operation of the pivotal gates for the outlet ports. In this embodiment, the adjustable outlet port means comprises eight outlet chutes 59 and the outlet chutes are arrayed in two successive rows 61 of four chutes spaced substantially the same distance as the ties, four of the outlet chutes at each rail being arranged above a respective intersection of each rail and tie in the range of the ballast where the tamping tools are immersed. This arrangement is particularly useful for track leveling and ballast tamping machines operating under conditions requiring a considerable amount of ballast, such as the laying of a new track section on an excavated and planed track bed. This outlet port means arrangement makes it possible to fill the cribs of the excavated track bed with a sufficient amount of ballast for proper tamping of the ties in a single operating cycle.

Ballast conveyor means 62 extending above machine frame 49 and mounted thereon comprises two successive conveyor bands forming an extension of conveyor 64 on ballast transport freight train 63 and conveying ballast to the forward portion of machine frame 49 where container 58 is mounted. Each car of the freight train is self-propelled and has a partition wall 65 displaceable in the operating direction indicated by arrow 66. A vertically adjustable broom arrangement 67 including a rotary broom is attached to the rear end of standard vehicle 45.

With standard vehicle 45 coupled to a front end of ballast transport train 63 adapted for continuous movement along the track, track lifting and ballast tamping units 55, 54 being mounted on frame 49 for relative longitudinal movement with respect thereto and drive 56 effectuating the longitudinal movement, ballast conveyor arrangement 64 on train 63 can convey transported ballast from the train to the standard vehicle coupled to the front end thereof, and ballast conveyor means 62 on frame 49 being in alignment with, and constituting an extension of, ballast conveyor arrangement 64 will convey the ballast to storage container 58 to supply sufficient quantities of ballast for a completely new track bed on which new track sections may be laid from a track renewal train. At the same time and while the ballast transport train and the standard vehicle advance continuously and ballast is supplied continuously, the track lifting and ballast tamping units are displaceable cyclically from tie to tie by drive 56.

FIG. 5 illustrates independently operating track leveling and ballast tamping machine 69 arranged to follow behind the rear end of ballast cleaning machine 91 adapted for continuous movement along the track in the operating direction. The ballast cleaning machine comprises endless ballast excavating chain 92 arranged to excavate ballast and convey it to a vibratory screening installation whence the cleaned ballast is deposited on conveyor arrangement 94 for redistribution. The track leveling and ballast tamping machine comprises frame 70, two undercarriages 71 supporting the frame for movement in an operating direction indicated by arrow 75 along track 74 comprised of two rails 72 fastened to ties 73. A driver's cab 76 is mounted on frame 70 at each end thereof and operator's cab 77 comprising a control panel is arranged immediately ahead of rear driver's cab 76 within view of ballast tamping unit 79. Drive 78 intermittently moves frame 70 along track 74, as indicated by arrows 86. The illustrated ballast tamping unit is a twin tamping head for simultaneously tamping two adjacent ties 73 and track lifting/lining unit 80 is arranged ahead of the ballast tamping unit. Track leveling reference system 81 controls the lifting of track 74 by track lifting unit 80. Ballast receiving and storage container 82 with outlet port means 84 adjustable by pivotal gates 83 is mounted on machine frame 70 immediately behind front undercarriage 71. Ballast conveyor means 85 is arranged on frame 70 for conveying ballast to ballast receiving and storage container 82 from a front end of the frame, in the operating direction, and comprises vertically adjustable elevating conveyor band 87 projecting forwardly from the front frame end and a ballast receiving plow means facing the rear ballast cleaning machine end. The plow means includes center plow 88 and laterally arranged ballast guide plates 89 and ballast elevating conveyor band 87 has an input end adjacent the plow means for receiving ballast therefrom and a discharge end arranged adjacent ballast receiving and storage container 82 for delivering ballast thereto. Vertically adjustable broom arrangement 90 comprising a rotary broom is mounted at the rear end of machine 69. Additional endless conveyor bands 93 are mounted on machine 69 for bringing ballast to container 82 from a trailing ballast transport train, for example as shown in connection with FIG. 4.

This machine is particularly useful in conjunction with a ballast cleaning machine since the latter irregularly distributes the cleaned ballast and the machine enables the ballast to be distributed homogeneously for obtaining a good tie tamping quality, the machine enabling the track to be leveled and lined, if desired, and permanently fixed in its corrected position immediately behind the ballast cleaning machine in a single operating stage. The ballast receiving and storage container is filled with excess ballast distributed by conveyor arrangement 94, and optionally by conveyor bands 93, and is discharged, as needed, through adjustable outlet port means 83, 84. In this way, the conventionally used special ballast plow between the ballast cleaning and tamping machines is no longer needed.

FIG. 6 shows track leveling and ballast tamping machine 95 comprising a standard vehicle capable of being coupled to a train and having frame 96, two undercarriages 98 supporting the frame for continuous movement in an operating direction indicated by arrow 123 along track 101 comprised of two rails 99 fastened to ties 100 defining cribs therebetween, undercarriages 98 being sufficiently spaced apart in the operating direction to permit lifting of track 101 therebetween. Drive 97 moves vehicle frame 96 along the track. A driver's cab 102 is arranged at each end of frame 96 and operator's cab 103 with central control panel 104 is arranged ahead of rear driver's cab 102, in the operating direction, within view of ballast tamping unit 105 and track lifting unit 106. Tool carrier frame 109 is connected to standard vehicle frame 96 for relative longitudinal movement with respect thereto. Drive 108 effectuates the longitudinal movement of the tool carrier frame whereby the standard vehicle may move continuously along the track in the operating direction while the tool carrier frame is driven intermittently, as indicated by arrows 128. The track lifting and ballast tamping units are mounted on the tool carrier frame at a fixed distance from each other for common movement with respect to the standard vehicle frame. The illustrated ballast tamping unit is arranged for the simultaneous tamping of two adjacent ties 100, i.e. it is a twin tamping head with adjacent pairs of vibratory and reciprocatory tamping tools. However, the rearmost tamping tool may be vertically adjusted into a raised position shown in full lines, in which position it is inoperative and the tamping unit tamps only a single tie. In its lowered, operative position shown in broken lines in FIG. 6, two ties are tamped simultaneously.

Ballast receiving and storage container 110 is mounted on frame 96 ahead of the ballast tamping and track lifting units, and the container has adjustable outlet ports means constituted by outlet openings 111 leading to outlet chutes 112 for distributing ballast in cribs between the ties. The distance between ballast receiving and storage container 110 and a front end of track lifting unit 106 in a rearmost position thereof, in the operating direction, is at least twice the spacing between successive ties 100. This spacing assures that there is sufficient time available for the tamping cycle, which occurs while the track lifting and ballast tamping units remain stationary and the machine frame with the ballast receiving and storage container advances non-stop to supply a continuous flow of ballast to the track bed through the adjustable outlet port means of the container.

Outlet chutes 112 extend along the ties at least over a range corresponding to the tamping spots, i.e. where the tamping tools are immersed in the ballast along the longitudinal edges of the ties for tamping ballast thereunder. The outlet chutes are displaceably mounted in longitudinal guide 113 of container 110 for displacement in the operating direction in increments corresponding to at least one tie spacing, the selected positions of outlet chutes 112 being shown in broken and full lines in FIG. 6. A drive is provided for the displacement of the outlet chutes, which is illustrated as connecting rod 114 which is coupled to tool carrier frame 109 and, thus, synchronized with drive 108. In this manner, the ballast outlet port means is coordinated with the ballast tamping unit for common intermittent movement therewith, the outlet openings preferably being closed during the return stroke of the outlet chutes into their starting position. This assures that ballast will be supplied only to the cribs between the ties.

Ballast metering means 115 is arranged at the front of container 110 and is associated with adjustable outlet port means 111, 112 for controlling the adjustment of the outlet port means. The illustrated metering means comprises closure means for the adjustable outlet port means, i.e. a slidable gate 117 for closing outlet openings 111, hydraulic drive 116 connected to the slidable gate for sliding the same, and switching means constituted by limit switch 118 for actuating the hydraulic drive.

Standard vehicle 95 may be used independently, for example for operation behind a ballast cleaning machine 119, schematically indicated in dash-dotted lines, which may carry a retractable ballast conveyor for selectively delivering cleaned ballast. For this purpose, ballast conveyor means 120 arranged on frame 96 for conveying delivered cleaned ballast to ballast receiving and storage container 110 comprises vertically adjustable broom arrangement 121 mounted on the front frame end and endless ballast elevating conveyor band 122 having an input end adjacent broom arrangement 121 and a discharge end arranged adjacent ballast receiving and storage container 110 for delivering the cleaned ballast thereto. This arrangement is particularly useful when the machine is operated in conjunction with a ballast cleaning machine or in track sections in which the ballast has not yet been properly distributed over the track bed areas where the tamping tools are immersed for tamping the ties. Conventionally, a special ballast plow machine was used under such circumstances for properly distributing the ballast. The present machine combines the outstanding advantages of a continuously advancing tamper with a proper supply and distribution of ballast necessary for a high-quality tamping operation, without the need of an additional machine, any excess ballast being conveyed by conveyor means 120 to container 110 for distribution to the cribs or moved away to the rear by the endless conveyor band.

As shown in broken lines in FIG. 6, the conveyor means preferably comprises an endless conveyor band arranged on frame 96 and extending thereover from a rear frame end to the ballast receiving and storage container, and the endless conveyor band may be reversibly driven in, and opposite to, the operating direction shown by arrow 123. A ballast deflecting device is arranged above ballast receiving and storage container 110 for selectively deflecting ballast conveyed by the single endless conveyor band into the container. In this way, the machine may be universally used by selectively supplying ballast to container 110 from the front and/or the rear of the machine, depending on need. Since the conveyor means is arranged above frame 96, it will in no way interfere with the operation of the container or the track lifting and ballast tamping units. The conveyor arrangement is simple and may be readily retrofitted on existing track leveling and tamping machines. It not only enables the track bed to be provided with sufficient ballast for tamping in a single operating stage with the tamping itself but, at the same time, an excess ballast may be readily moved away from the machine to a ballast transporting freight train running behind the machine in the manner illustrated in FIG. 4.

The operation of the track leveling and ballast tamping machines illustrated by way of example in the accompanying drawing will partly be obvious from the above description of the structure thereof and will be explained in detail hereinafter.

Generally conventional and only schematically indicated track renewal train 7 advances continuously in the operating direction indicated by arrow 11 while removing the old ties and rails of the track to provide a trackless section where the ballast is planed and excess ballast is removed by excavating chain 38 to be conveyed rearwardly by conveyor 20 extending above tie laying device 41 to ballast conveyor means 18 of track leveling and ballast tamping machine 1 which also advances non-stop in the operating direction. With deflecting device 21 in the position shown in FIG. 2, the entire ballast delivered by conveyor 20 is thrown into ballast receiving and storage container 14. The operator in cab 27 operates not only the immersion and reciprocation of the tamping tools of tamping tool unit 12 in the ballast for tamping the ties but also the cyclical movement of track lifting unit 13 and ballast tamping unit 12 while track renewal train 7 and track leveling and ballast tamping machine 1 advance continuously. The operator is also able to view the ballast flow through the adjustable outlet port means of ballast receiving and storage container 14 and thus to control the amount of the ballast delivered to the cribs at the points of tamping by operating the hydraulically pivotal pairs of gates 17 which determine the size of outlet openings 15. In this manner, the ballast stored in container 14 is delivered to outlet chutes 43 disposed at both sides of rails 4 at the intersections of the rails and ties and central outlet chute 44 between the newly laid ties 5, as shown in FIG. 3, to provide a desired amount of ballast for support of the newly laid ties and tamping. In this way and regardless of the ballast condition prevailing at the tamping site, sufficient ballast will be available under all conditions for obtaining a uniform, homogeneous and long-lasting tamped ballast bed for support of the leveled and, if desired, lined track. Any excess ballast remaining on ties 5 will be swept up by rear broom 31 and moved to the track shoulder by transverse conveyor 38. In this manner, nothing will disturb the work of the operators in cabs 34, who fasten the newly laid rails 4 to newly laid ties 5. If there is little need for additional ballast for tamping the new ties and container 14 is filled with ballast, deflecting device 21 is repositioned, i.e. pivoted forwardly, so that the ballast excavated by chain 38 and conveyed by conveyors 20 and 19 is directed to conveyors 22 whence it is thrown into a freight car following machine 1. If deflecting device 21 is pivoted into a centered position, a portion of the ballast will be thrown into container 14 while another portion will be transported rearwardly.

The universal adaptability of the track leveling and ballast tamping machine of the present invention is further illustrated in the embodiment of FIG. 4 wherein machine 45 is used for fixing a newly laid track in a desired position, the relatively heavy cars of ballast transport train 63 advancing on the previously leveled and tamped track section. With this machine combination, a sufficient amount of ballast is constantly available for a tamping operation designed to fix an extended length of track in the corrected position without requiring a neighboring track to be barred to regular traffic because it is needed for the transport of ballast to the tamping site. The self-propelled standard vehicle used for track leveling and ballast tamping machine 45 is used as the lead car for ballast transport freight train 63 comprised of a great number of freight cars. In this arrangement, ballast conveyor means 62 mounted on frame 49 of machine 45 for conveying ballast to ballast receiving and storage container 58 in a forward portion of the machine frame forms a forward extension of conveyor 64 on ballast transport freight train 63. The conveyed ballast is discharged in accordance with the prevailing need through adjustable outlet ports 60. Tie sensor 68 closes the outlet ports when it senses a tie and the outlet ports are in exact vertical alignment with the tie. When the outlet ports are aligned with a crib, they can be opened to discharge ballast into the crib. Since ballast tamping and track lifting units 54 and 55 are displaceable relative to machine frame 49, they may be cyclically moved for intermittent leveling and tamping of successive ties while machine 45 and train 63 advance non-stop in the operating direction indicated by arrow 66.

The intermittently advancing track leveling and ballast tamping machine 69 of FIG. 5 is operated immediately behind continuously advancing ballast cleaning machine 91 without requiring an intermediate ballast plow machine. In this embodiment, the track leveling and ballast tamping machine solves the problem of compensating for the varying amounts of cleaned ballast redistributed by the ballast cleaning machine. This is due to the fact that the amount of dirt in the ballast bed varies and, therefore, less cleaned ballast is generated the more dirt is removed on the screens of the ballast cleaning machine. With the machine combination illustrated in FIG. 5, if too much cleaned ballast is redistributed by machine 91, it is received and conveyed by elevating conveyor band 87 to container 82 where it is stored. If not enough cleaned ballast is available to assure effective tie tamping, stored ballast is released from ballast receiving and storage container 82 through outlet chutes 84 in metered amounts. In this way, a uniform ballast bed is prepared for the effective operation of succeeding ballast tamping unit 79 to enable the same to produce a uniform and permanent ballast support for the leveled track. The uniform distribution of the ballast is of particular importance and great advantage since ballast excavating chain 92 has completely removed the old ballast bed and the new bed of cleaned ballast is totally loose, requiring a considerable amount of ballast in the cribs for the effective tamping of the ties. In this connection, the use of a twin tamping head will increase the efficiency of the operation. If not enough ballast has been made available to container 82 from the ballast cleaning machine, additional ballast may be conveyed to the container by additional conveyor bands 93 mounted on machine frame 70 for bringing ballast to the container from a trailing ballast transport freight train.

FIG. 6 shows non-stop track leveling and ballast tamping machine 95 operating behind work vehicle 119 which may be a ballast cleaning machine. Any ballast above the level of the track ties is swept up by broom arrangement 121 and conveyed by elevating conveyor band 122 to ballast receiving and storage container 110. Outlet chute 112 at the bottom of the container is connected with tool carrier frame 109 whereon ballast tamping and track leveling units 105, 106 are mounted and cyclically moves therewith from tamping stage to tamping stage. In the forward position of the outlet chute shown in dash-dotted lines, engagement of the outlet chute with limit switch 118 will cause actuation of hydraulic drive 116, causing slidable gate 117 to be displaced into the position shown in dash-dotted lines in FIG. 7 to open outlet port 111 of container 110 and to permit ballast to fall therethrough into outlet chute 112 whose smaller outlets direct the ballast into two adjacent cribs. To prevent the ballast from falling onto intermediate tie 100, a V-shaped baffle 127 is provided. As soon as outlet chute 112 contains the desired amount of ballast, hydraulic drive 116 is reversed to displace slidable gate 117 into its closing position over outlet port 11.

The spacing of outlet chute 112 from ballast tamping unit 105 by a multiple of the tie spacing assures that the preceding outlet chute will be accurately positioned with its outlets above two adjacent cribs while trailing ballast tamping unit 105 stands still to tamp tie 100. While machine 95 advances non-stop, outlet chute 112 is displaced along longitudinal guide 113 so that the ballast discharge always remains above a crib. In actual operation, the outlet chute 112 is emptied before it has reached its rearmost position (FIG. 6). As soon as after termination of the tamping tool carrier frame 109, together with outlet chute 112, has been displaced into its forward position in the direction of arrows 128, the described operating cycle is repeated. Since, as shown in FIG. 7, a total of four outlet chutes 112 are arranged at both sides of each rail 99 at each intersection of a tie and rail and each chute has two outlets discharging ballast respectively into adjacent cribs, a high efficiency and selectivity can be achieved in tailoring the ballast distribution to requirements. Rear broom arrangement 124 enables any excess ballast to be swept up and removed to the track shoulder by transverse conveyor 125. The arrangement of ballast receiving and storage container 110 on track leveling and ballast tamping machine 95 makes it possible to provide required amounts of ballast for effective tie tamping at all times without the need for an additional ballast plow machine for the proper distribution of ballast.

If leading work vehicle 119 is a ballast cleaning machine, for example, and this machine produces too much cleaned ballast for the succeeding tamping operation, causing container 110 to be filled with ballast, the cleaned ballast redistributing conveyor of the ballast cleaning machine, which is shown in dash-dotted lines in FIG. 6, may be displaced rearwardly until its discharge end is positioned above ballast receiving and storage container 110 and adjacent the end of the reversible conveyor band arranged on machine frame 96 and shown in broken lines. This conveyor band will transport the excess ballast to trailing freight cars. If, on the other hand, not enough cleaned ballast is generated by the ballast cleaning machine, the conveyor band is reversed again and can be used to transport ballast to container 110 from the trailing freight cars on which the ballast is stored. While track leveling and ballast tamping machine 95 has been shown as a non-stop machine, it could also be a conventional, cyclically advancing machine.

What is claimed is:

1. A track leveling, lining and ballast tamping machine comprising (a) a standard vehicle capable of being coupled to a train and having (1) a machine frame, (2) two undercarriages supporting the frame for movement in an operating direction along a track comprised of two rails fastened to ties defining cribs therebetween, the undercarriages being sufficiently spaced apart in said direction to permit lifting and lining of the track therebetween, and (3) a drive for moving the frame along the track, (b) a ballast tamping unit connected to the frame between the undercarriages and comprising pairs of vibratory and reciprocatory tamping tools movable towards each other for tamping ballast under successive ones of the ties, (c) a track lifting and lining unit connected to the frame between the undercarriages and ahead of the ballast tamping unit in the operating direction at a constant distance from the tamping unit, (d) a track leveling and lining reference system for controlling the lifting and lining of the track by the track lifting and lining unit, (e) a ballast receiving and storage container mounted on the frame ahead of the ballast tamping and track lifting and lining units in a forward portion thereof in the operating direction, the container having (1) adjustable outlet port means for distributing ballast in respective ones of the cribs, and (f) a ballast conveyor means mounted on the frame and leading from a forward end of the frame, in the operating direction, to the ballast receiving and storage container for conveying ballast thereto.

2. The machine of claim 1, further comprising a first operator's cab arranged on the frame within view of the track lifting and lining unit and ballast tamping unit, and a second operator's cab arranged on the frame at the front frame end within view of the ballast receiving and storage container for monitoring and controlling the adjustable outlet port means.

3. The machine of claim 2, wherein the adjustable outlet port means comprises outlet ports and hydraulically operable pivotal gates for controlling the flow of ballast through the ports.

4. The machine of claim 1, wherein the adjustable outlet port means comprises four outlet chutes extending over the respective crib, the outlet chutes being adjacent each other in a direction transverse to the operating direction.

5. The machine of claim 1, wherein the adjustable outlet port means comprises eight outlet chutes two of which are arranged adjacent each other at respective sides of each rail above respective intersections of the rails and adjacent ones of the ties, the chutes extending in the operating direction over two adjacent ones of the cribs, and a further outlet chute arranged behind the four outlet chutes in the operating direction for distributing ballast in a center region of the track between the rails.

6. The machine of claim 1, further comprising a ballast metering means associated with the adjustable outlet port means for controlling the adjustment of the outlet port means.

7. The machine of claim 6, wherein the ballast metering means comprises closure means for the adjustable outlet port means, a hydraulic drive means for operating the closure means, and a switching means operable to actuate the hydraulic drive means.

8. The machine of claim 1, wherein the standard vehicle is coupled to a track renewal train, the frame comprises a front part and a rear part pivotally connected to each other, the ballast conveyor means extending from the front frame part over the rear frame part, the track lifting and lining unit and ballast unit are mounted on the rear frame part for relative longitudinal movement with respect thereto, and further comprising a drive for effectuating said longitudinal movement, a series of operator s cabs mounted on an underside of the front frame part enabling operators therein to fasten the track rails to successive ones of said ties, conveyor band means mounted on the underside of the front frame part for conveying track rail fastening elements to said cabs.

9. The machine of claim 1, wherein the adjustable outlet port means comprises outlet chutes distributed along the length of the ties, and further comprising a longitudinal guide in the container for displaceably mounting the adjustable outlet port means for displacement in the operating direction in increments corresponding to at least one tie spacing, and a drive for the displacement of the outlet port means.

10. The machine of claim 9, wherein the track lifting and living unit and ballast tamping unit are connected to the machine frame for relative longitudinal movement with respect thereto, and further comprising a drive for effectuating said longitudinal movement, the displacement drive being coupled to the drive for moving the units.

11. The machine of claim 1, wherein the track lifting and living unit and ballast tamping unit, are connected to the machine frame for common relative longitudinal movement with respect thereto, and further comprising a drive for effectuating said longitudinal movement whereby the machine frame may move continuously along the track in the operating direction while the units are driven intermittently from tamping stage to tamping stage, the distance between the ballast receiving and storage container and a front end of the track lifting unit in a rearmost position thereof, in the operating direction, being at least twice the spacing between successive ties.

12. The machine of claim 1, further comprising a broom arrangement mounted on the machine frame behind the ballast tamping unit, in the operating direction, the broom arrangement comprising a vertically adjustable rotary broom rotatable about an axis extending transversely to the operating direction.

13. The machine of claim 12, wherein the broom arrangement is mounted on the frame behind a rear one of the undercarriages, in the operating direction.

14. A track leveling, lining and ballast tamping machine comprising (a) a standard vehicle capable of being coupled to a train and having
  (1) a machine frame,
  (2) two undercarriages supporting the frame for movement in an operating direction along a track comprised of two rails fastened to ties defining cribs therebetween, the undercarriages being sufficiently spaced apart in said direction to permit lifting and lining of the track therebetween, and
  (3) a drive for moving the frame along the track, (b) a ballast tamping unit connected to the frame between the undercarriages and comprising pairs of vibratory and reciprocatory tamping tools movable towards each other for tamping ballast under successive ones of the ties, (c) a track lifting and lining unit connected to the frame between the undercarriages and ahead of the ballast tamping unit in the operating direction at a constant distance from the tamping unit, (d) a track leveling and lining reference system for controlling the lifting and lining of the track by the track lifting and lining unit, (e) a ballast receiving and storage container mounted on the frame ahead of the ballast tamping and track lifting and lining units in a forward portion thereof in the operating direction, the container having (1) adjustable outlet port means for distributing ballast in respective ones of the cribs, and (f) a ballast conveyor means mounted on the frame and leading from a forward end of the frame, in the operating direction, to the ballast receiving and storage container for conveying ballast thereto, the ballast conveyor means comprising
  (1) an endless conveyor band mounted on the frame and extending at least partially thereover, and
  (2) drive means for reversibly driving the endless conveyor band in, and opposite to, said direction.

15. A track leveling, lining and ballast tamping machine comprising (a) a standard vehicle capable of being coupled to a train and having
  (1) a machine frame,
  (2) two undercarriages supporting the frame for movement in an operating direction along a track comprised of two rails fastened to ties defining cribs therebetween, the undercarriages being sufficiently spaced apart in said direction to permit lifting and lining of the track therebetween, and
  (3) a drive for moving the frame along the track, (b) a ballast tamping unit connected to the frame between the undercarriages and comprising pairs of vibratory and reciprocatory tamping tools movable towards each other for tamping ballast under successive ones of the ties, (c) a track lifting and lining unit connected to the frame between the undercarriages and ahead of the ballast tamping unit in the operating direction at a constant distance from the tamping unit, (d) a track leveling and lining reference system for controlling the lifting and lining of the track by the track lifting and lining unit, (e) a ballast receiving and storage container mounted on the frame ahead of the ballast tamping and track lifting and lining units in a forward portion thereof in the operating direction, the container having (1) adjustable outlet port means for distributing ballast in respective ones of the cribs, and (f) a ballast conveyor means mounted on the frame and leading from a forward end of the frame, in the operating direction, to the ballast receiving and storage container for conveying ballast thereto, the ballast conveyor means comprising
  (1) a vertically adjustable broom arrangement mounted on said forward frame end, and
  (2) an endless ballast elevating conveyor band having an input end adjacent the broom arrangement for receiving swept ballast therefrom and a discharge end arranged adjacent the ballast receiving and storage container for delivering ballast thereto.

16. The machine of claim 15, further comprising a tool carrier frame connected to the machine frame for relative longitudinal movement with respect thereto, a drive for effectuating said longitudinal movement of the tool carrier frame whereby the machine frame may move continuously along the track in the operating direction while the tool carrier frame is driven intermittently, the track lifting and lining unit and ballast tamping unit being mounted on the tool carrier frame.

17. A track leveling, lining and ballast tamping machine comprising (a) a standard vehicle capable of being coupled to a train and having
  (1) a machine frame,
  (2) two undercarriages supporting the frame for movement in an operating direction along a track comprised of two rails fastened to ties defining cribs therebetween, the undercarriages being sufficiently spaced apart in said direction to permit lifting and lining of the track therebetween, and
  (3) a drive for moving the frame along the track, (b) a ballast tamping unit connected to the frame between the undercarriages and comprising pairs of vibratory and reciprocatory tamping tools movable towards each other for tamping ballast under successive ones of the ties, (c) a track lifting and lining unit connected to the frame between the undercarriages and ahead of the ballast tamping unit in the operating direction at a constant distance from the tamping unit, (d) a track leveling and lining reference system for controlling the lifting and lining of the track by the track lifting and lining unit, (e) a ballast receiving and storage container mounted on the frame ahead of the ballast tamping and track lifting and lining units in a forward portion thereof in the operating direction, the container having
  (1) adjustable outlet port means for distributing ballast in respective ones of the cribs, (f) a ballast conveyor means mounted on the frame and leading from a forward end of the frame, in the operating direction, to the ballast receiving and storage container for conveying ballast thereto, (g) a single endless conveyor band mounted on the frame and extending thereover from a rear frame end to the ballast receiving and storage container, and (h) drive means for reversibly driving the endless conveyor band in, and opposite to, said direction.

18. The machine of claim 17, further comprising a ballast deflecting device arranged above the ballast receiving and storage container for selectively deflecting ballast conveyed by the single endless conveyor band into the container.

19. A track leveling, lining and ballast tamping machine comprising (a) a standard vehicle coupled to a track renewal train comprising (1) a two-part main car frame, (2) means on the main car frame for receiving old ties and for laying new ties, (3) a ballast excavating chain, and (4) a ballast conveyor arrangement for receiving ballast from the ballast excavating chain and conveying the received ballast, and the standard vehicle having (5) a machine frame comprising a front part and a rear part pivotally connected to each other, (6) two undercarriages supporting the frame for movement in an operating direction along a track comprised of two rails fastened to ties defining cribs therebetween, the undercarriages being sufficiently spaced apart in said direction to permit lifting and lining of the track therebetween, and (7) a drive for moving the frame along the track, (b) a ballast tamping unit connected to the frame between the undercarriages and comprising pairs of vibratory and reciprocatory tamping tools movable towards each other for tamping ballast under successive ones of the ties, (c) a track lifting and lining unit connected to the frame between the undercarriages and ahead of the ballast tamping unit in the operating direction at a constant distance from the tamping unit, (d) the track lifting and lining unit and ballast tamping unit being mounted on the rear frame part for relative longitudinal movement with respect thereto, (e) a drive for effectuating said longitudinal movement, (f) a track leveling and lining reference system for controlling the lifting and lining of the track by the track lifting and lining unit, (g) a ballast receiving and storage container mounted on the frame ahead of the ballast tamping and track lifting and lining units in a forward portion thereof in the operating direction, the container having (1) adjustable outlet port means for distributing ballast in respective ones of the cribs, (h) a ballast conveyor means mounted on the machine frame of the standard vehicle and leading from a forward end of the machine frame, in the operating direction, to the ballast receiving and storage container for conveying ballast thereto, the ballast conveyor means comprising (1) a series of successive conveyor bands extending above the front and rear frame part, the successive conveyor bands being in alignment with, and constituting an extension of, the ballast conveyor arrangement, (i) a ballast deflecting device arranged above the ballast receiving and storage container for selectively deflecting ballast conveyed by the successive conveyor bands into the container or to a successive one of the conveyor bands, (j) a series of operator's cabs mounted on an underside of the front frame part enabling operators therein to fasten the track rails to successive ones of said ties, and (k) conveyor band means mounted on the underside of the frame frame part for conveying track rail fastening elements to said cabs.

20. A track leveling, lining and ballast tamping machine comprising (a) a standard vehicle coupled to a front end of a ballast transport train adapted for continuous movement along the track, the ballast transport train comprising (1) a ballast conveyor arrangement mounted on the ballast transport train for conveying transported ballast from the train to the standard vehicle coupled to the front end thereof and the standard vehicle having (2) a machine frame, (3) two undercarriages supporting the frame for movement in an operating direction along a track comprised of two rails fastened to ties defining cribs therebetween, the undercarriages being sufficiently spaced apart in said direction to permit lifting and lining of the track therebetween, and (4) a drive for moving the frame along the track, (b) a ballast tamping unit connected to the frame between the undercarriages and comprising pairs of vibratory and reciprocatory tamping tools movable towards each other for tamping ballast under successive ones of the ties, (c) a track lifting and lining unit connected to the frame between the undercarriages and ahead of the ballast tamping unit in the operating direction at a constant distance from the tamping unit, (d) the track lifting and lining unit and ballast tamping unit being connected to the machine frame for relative longitudinal movement with respect thereto (e) a drive for effectuating said longitudinal movement, (f) a track leveling and lining reference system for controlling the lifting and lining of the track by the track lifting and lining unit, (g) a ballast receiving and storage container mounted on the frame ahead of the ballast tamping and track lifting and lining units in a forward portion thereof in the operating direction, the container having (1) adjustable outlet port means for distributing ballast in respective ones of the cribs, and (h) a ballast conveyor means mounted on the machine frame of the standard vehicle and leading from a forward end of the machine frame, in the operating direction, to the ballast receiving and storage container for conveying ballast thereto, the ballast conveyor means being in alignment with, and constituting an extension of, the ballast conveyor arrangement.

21. The machine of claim 20, wherein he adjustable outlet port means comprises eight outlet chutes, the outlet chutes being arrayed in two successive rows spaced substantially the same distance as the ties, four of the outlet chutes at each rail being arranged above a respective intersection of each rail and tie.

22. A track leveling, lining and ballast tamping machine comprising (a) a standard vehicle capable of being coupled to a train and arranged to follow behind a rear end of a ballast cleaning machine adapted for continuous movement along the track in the operating direction, the standard vehicle having (1) a machine frame, (2) two undercarriages supporting the frame for movement in an operating direction along a track comprised of two rails fastened to ties defining cribs therebetween, the undercarriages being sufficiently spaced apart in said direction to permit lifting and lining of the track therebetween, and (3) a drive for moving the frame along the track intermittently between successive tamping stages.

(b) a ballast tamping unit connected to the frame between the undercarriages and comprising pairs of vibratory and reciprocatory tamping tools movable towards each other for tamping ballast under successive ones of the ties, (c) a track lifting and lining unit connected to the frame between the undercarriages and ahead of the ballast tamping unit in the operating direction at a constant distance from the tamping unit, (d) a track leveling and lining reference system for controlling the lifting and lining of the track by the track lifting and lining unit, (e) a ballast receiving and storage container mounted on the frame ahead of the ballast tamping and track lifting and lining units in a forward portion thereof in the operating direction, the container having (1) adjustable outlet port means for distributing ballast in respective ones of the cribs, and (f) a ballast conveyor means mounted on the frame and leading from a forward end of the frame, in the operating direction, to the ballast receiving and storage container for conveying ballast thereto, the ballast conveyor means comprising (1) a vertically adjustable ballast elevating conveyor band projecting forwardly from the forward frame end and (2) a ballast receiving plow means facing the rear ballast cleaning machine end, the plow means including a center plow and laterally arranged ballast guide plates, and (3) the ballast elevating conveyor band having an input end adjacent the plow means for receiving ballast therefrom and a discharge end arranged adjacent the ballast receiving and storage container for delivering ballast thereto.

* * * * *